United States Patent [19]

Yokoyama et al.

[11] Patent Number: 4,752,660

[45] Date of Patent: Jun. 21, 1988

[54] CURRENT LIMITING CIRCUIT BREAKER WITH AN ARC SHEARING PLATE

[75] Inventors: Yoichi Yokoyama; Hideya Kondo; Yoichi Kunimoto; Shigeru Honoki, all of Kadoma, Japan

[73] Assignee: Matsushita Electric Works, Ltd., Japan

[21] Appl. No.: 947,889

[22] Filed: Dec. 30, 1986

[30] Foreign Application Priority Data

Jan. 10, 1986 [JP] Japan ..... 61-3912
Mar. 5, 1986 [JP] Japan ..... 61-48088
May 26, 1986 [JP] Japan ..... 61-120709

[51] Int. Cl.[4] ..... H01H 9/32; H01H 33/06
[52] U.S. Cl. ..... 200/151; 200/144 R
[58] Field of Search ..... 200/151, 148 R, 144 R

[56] References Cited

U.S. PATENT DOCUMENTS 3,842,228 10/1974 Green .
4,458,225 7/1984 Forsell ..... 200/151
4,467,298 8/1984 Belbel et al. .
4,562,323 12/1985 Belbel et al. .
4,604,596 8/1986 Yokoyama et al. ..... 335/14
4,647,741 3/1987 Belbel et al. ..... 200/151

*Primary Examiner*—E. A. Goldberg
*Assistant Examiner*—Lincoln Donovan
*Attorney, Agent, or Firm*—Stevens, Davis, Miller & Mosher

[57] ABSTRACT

A circuit breaker includes an arc shearing plate which is driven to thrust between a pair of contacts being separated so as to shear an arc formed therebetween for rapid arc extinction. Included in the circuit breaker is an over-current responsive actuating member which applies an impact to one of the contacts for rapid contact separation in response to a predetermined over-current condition such as caused by a short-circuit. The actuating member is also coupled to the arc shearing plate so as to control the thrusting movement of the arc shearing plate in synchronism with the rapid contact separation, whereby the timing of inserting the plate between the contacts can be easily controlled with respect to that of separating the contacts for achieving rapid arc extinction and providing a high arc voltage and current limiting action.

14 Claims, 16 Drawing Sheets

CURRENT LIMITING CIRCUIT BREAKER WITH AN ARC SHEARING PLATE

BACKGROUND OF THE INVENTION

1. Field of the Invention

The present invention is directed to a current limiting circuit breaker with an arc shearing plate which is controlled to move into a position for rapid extinction of an arc formed between contacts being separated upon the occurrence of a predetermined over-current condition.

2. Information Disclosure of the Prior Art

A circuit breaker with an arc shearing plate is already known in the art, as disclosed in the following U.S. patents:

(1) U.S. Pat. No. 3,842,228;

(2) U.S. Pat. No. 4,467,298; and (3) U.S. Pat. No. 4,562,323.

The patent (1) discloses a circuit breaker in which a wedge member of dielectric material is controlled by a solenoid to thrust between a pair of electrical contacts for opening the contacts and at the same time shearing the arc formed between the contacts.

The patent (2) discloses a circuit breaker in which an arc shearing plate is spring biased to thrust between a pair of electrical contacts as soon as the contacts are electromagnetically repelled to its open position.

The patent (3) discloses a circuit breaker in which an arc shearing plate is controlled by a solenoid to thrust between a pair of electrical contacts after the contacts are driven to move its open position by a control means which is a separately mounted from the solenoid and operates independently thereof.

In the circuit breakers according to the above patents (1) and (2), the arc shearing plate suffers from high frictional forces as it moves to a position of interposing itself between the contacts due to the wedge engagement of the arc shearing plate with the contacts. The high frictional forces inevitable with this type of circuit breaker will retard the movement of the plate and consequently require a relatively longer time for shearing an arc formed between the contacts being separated.

In the circuit breaker according to the above patent (3), the arc shearing plate and the contacts are controlled by individual control means, i.e., respectively by the electromagnet and another fault-current responsive member provided separately therefrom. Although this provision of separate control means is effective for obtaining rapid movement of the arc shearing plate to its interposed position between the contacts, it requires duplication of the fault-current responsive members with the consequent difficulty in controlling to match the timing of inserting the plate to that of separating the contacts. This makes it difficult to obtain an optimum operating characteristic of the arc shearing plate which is to be determined in close association with the contact separation. In this sense, none of the prior circuit breakers shows the use of a single over-current responsive actuator as a common member for controlling the contact separation as well as for thrusting of the arc shearing plate between the contacts in a synchronized sequence.

SUMMARY OF THE INVENTION

The present invention obviates the above problem and provides an improved circuit breaker with an arc shearing plate which has a superior operating characteristic for rapid arc extinction. The circuit breaker in accordance with the present invention includes a pair of electrical contacts mounted within a housing wherein at least one of the contacts is movable with respect to the other contact between open and closed positions. An over-current responsive actuating member is operatively connected to the movable contact for applying thereto a contact opening impact so as to make a rapid contact separation in response to a predetermined value of over-current value. Mounted within the housing is an arc shearing plate which is movable between a rest position where it is away from the contacts and a shielding position where it is interposed between the contacts being separated. The arc shearing plate is operatively connected to the over-current responsive member such that it is driven thereby to move, in synchronism with the rapid contact separation due to the over-current condition, into the shielding position for shearing the arc formed between the contacts being separated. Thus, the over-current responsive actuating member acts not only to provide the contact opening impact for rapid contact separation but also to thrust the arc shearing plate into the shielding position upon the occurrence of the predetermined over-current condition. With this result, the timing of inserting the arc shearing plate between the contacts can be easily controlled in close association with that of separating the contacts so that the arc shearing plate can thrust between the contacts in an optimum manner for effective arc extinction.

Accordingly, it is a primary object of the present invention to provide a circuit breaker in which an arc shearing plate can be conveniently controlled by a common over-current responsive making a rapid contact separation in response to a predetermined over-current condition so as to be forced to move between the separated contacts in an optimum manner effective for providing a high arc voltage and current limiting action.

In preferred embodiments, the over-current responsive actuating means comprises a solenoid with a plunger which has its one end bearing directly upon a movable contact arm carrying the movable contact so that it provides a high impact to the movable contact arm for effecting rapid contact separation. This rapid contact separation coacting with the simultaneous interposition of the arc shearing plate for greatly increasing an arc voltage without the use of a conventional space-consuming arc chute and/or arc blow-out means, whereby enabling the compact arrangement of the circuit breaker with a high arc voltage and current interrupting action.

It is therefore another object of the present invention to provide a current limiting circuit breaker capable of being made compact yet assuring an enhanced arc extinction capability.

In the circuit breaker of the present invention, the movable contact is operatively connected through a mechanical linkage to a contact operating mechanism including a manual handle and a latchable member which is movable between a latched position of holding the contacts in the closed position and an unlatched position of holding the contacts in the open position. Operatively connected to the mechanical linkage is a trip mechanism which releases the latchable member to its unlatched position for tripping the contacts to open in response to an overload condition. The trip mechanism is in turn connected to the over-current responsive actuating member or solenoid so that, upon the occurrence of the over-current condition, the solenoid serves to trip the mechanical linkage substantially at the same time of applying the contact opening impact for rapid contact separation. That is, once the rapid contact separation due to the over-current condition takes place, the trip mechanism is concurrently operative in response to such over-current condition to keep the contacts opened for safely preventing the reclosing of the contacts.

It is therefore a further object of the present invention to provide a current limiting circuit breaker in which a trip mechanism is systematically coupled with the over-current responsive mechanism to hold the contacts in the open position once they are separated by the operation of the over-current responsive actuating mechanism for protecting the circuit.

In a preferred embodiment, the arc shearing plate is interlocked with a trip link which is included in the trip mechanism for tripping the contact operating mechanism to the open position upon being actuated by the solenoid. The arc shearing plate thus interlocked with the trip link can be therefore driven to move to the shielding position by better utilization of the trip mechanism incorporated in the circuit breaker, contributing to reducing a number of moving parts required for the driving connection between the solenoid and the plate, which is therefore a further object of the present invention.

In another preferred embodiment, the plunger of the solenoid is connected to the arc shearing plate by means of a leverage mechanism which multiplies the motion of the plunger for giving to the arc shearing plate enough travel distance for movement from its rest position to its shielding position. This compensates for insufficient travel distance generally expected for the plunger itself of the solenoid while increasing the speed of the movement of the arc shearing plate to the shielding position.

It is therefore a still further object of the present invention to provide a circuit breaker in which the arc shearing plate is effectively connected to the solenoid for rapid movement to the shielding position responsive to the over-current condition.

The present invention discloses a further advantageous features in which the arc shearing plate is directly connected to a movable contact arm carrying the movable contact so as to be driven thereby to move to the shielding position simultaneously with the high speed contact separating movement of the contact arm.

The housing of the circuit breaker is formed integrally or separately with a member having therein a channel through which the arc shearing plate is guided for movement between the rest and shielding positions. The member is preferably slotted at a portion receiving the leading edge of the arc shearing plate to provide thereat an air vent through which the channel is in open communication with the outside of the member in order to displace the air outwardly of the channel therethrough as the leading edge of the plate advances for abutment with the wall of the channel, thus preventing the bouncing of the plate and assuring smooth movement thereof to the shielding position. Preferably, the member is made from a material having a high rate of arc extinguishing gas generation by ablation when exposed to the intense heat of the arc formed between the contacts being separated so as to further improve rapid arc extinction performance.

It is therefore a further object of the present invention to provide a circuit breaker in which the arc shearing plate is coactive with the arc extinguishing ablative material to greatly improve the arc extinction performance.

These and still other objects and advantages will be more apparent from the following description of the preferred embodiments when taken in conjunction with the accompanying drawings. cBRIEF DESCRIPTION OF THE DRAWINGS FIG. 1 is a sectional view of a circuit breaker shown in its contact closed position in accordance with a first preferred embodiment of the present invention;

DETAILED DESCRIPTION OF THE PREFERRED EMBODIMENTS

First embodiment [FIGS. 1 to 4]

Figure 1:
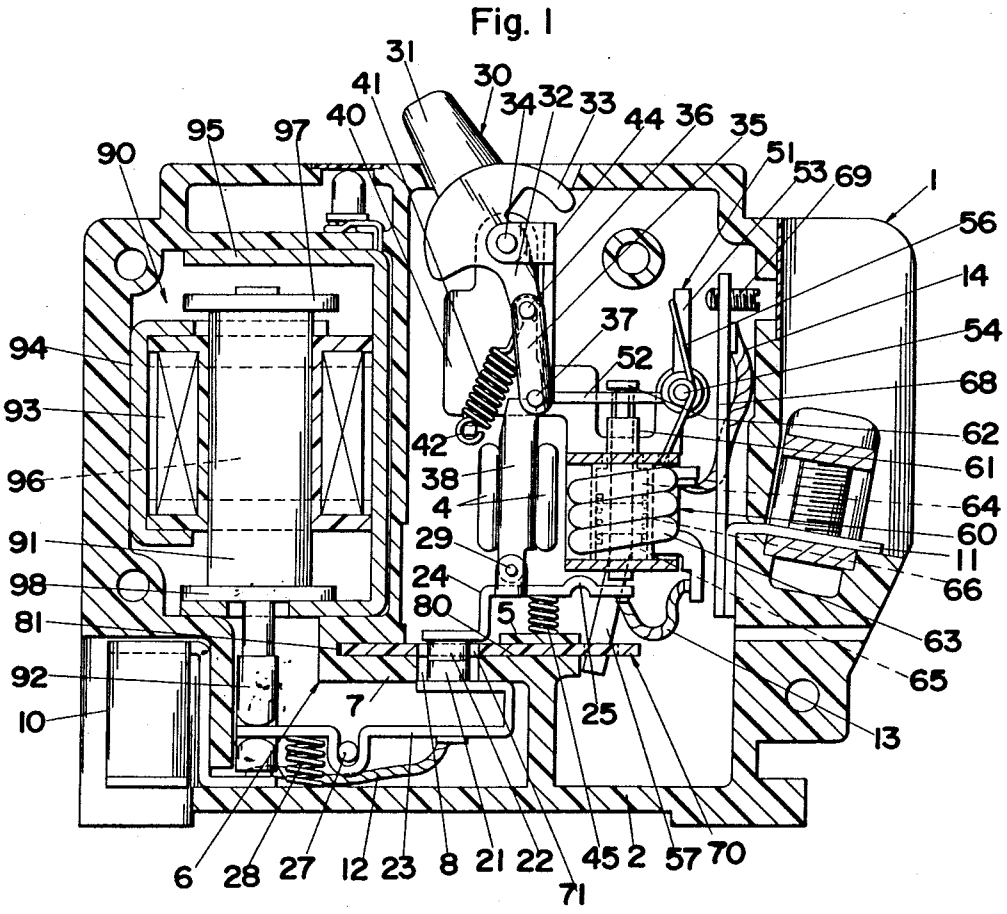
Figure 2:
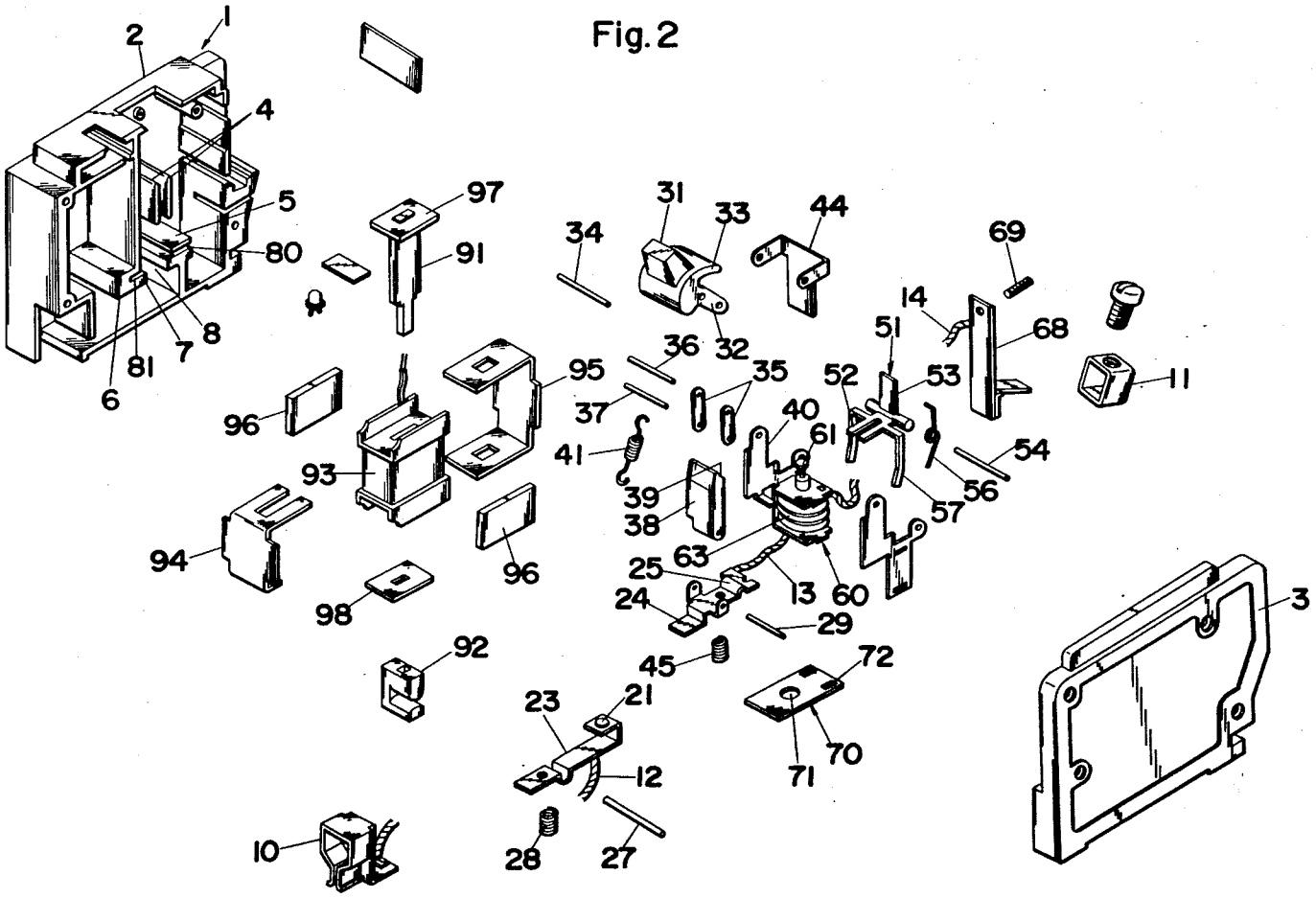
FIG. 2 is an exploded perspective view of the above circuit breaker.

Referring now to FIGS. 1 to 4, there is shown a circuit breaker in accordance with a first preferred embodiment of the present invention. The circuit breaker illustrated is of a remotely controllable type which is controlled by a control signal remote from the breaker to open its contacts independently of the manual switching operation of the breaker. The circuit breaker includes a molded housing 1 made of a dielectric material and consisting of a base 2 and a cover 3 held together by means of suitable fastening means. Mounted within the housing 1 is a set of first and second electrical contacts 21 and 22 respectively held on first and second arms 23 and 24 which are in turn electrically connected to line and load terminals 10 and 11 on the opposite ends of the housing 1. The first arm 23 is normally kept stationary by a remote signal responsive actuating unit 90, the detail of which will be described later, and is electrically connected to the line terminal 10 through a braid 12. The second arm 24 is actuated by an operating mechanism 30 to be movable with respect to the first arm 23 for movement between an open position and a closed position and electrically connected to the load terminal 11 through suitable current sensing elements and braids 13 and 14.

The operating mechanism 30 comprises a handle 31 mounted on the housing to be pivotable about a fixed pin 34, a pivot link 35, and an operator rod 38. The pivot link 35 has a pair of parallel pivot pins 36 and 37, the upper one of which is connected to a downward extension 32 of the handle 31 so that the pivot link 35 forms with the extension 32 a toggle linkage. The other pivot pin 37 is engageable with a notch 39 at the upper end of the operator rod 38. The operator rod 38 is guided between a pair of vertically extending projections 4 on the base 2 to be vertically movable. The second arm 24 carrying the second or movable contact 22 is pivotally connected at a portion intermediate its longitudinal ends by means of a pin 29 to the lower end of the operator rod 38 so as to establish the mechanical linkage from the second contact 22 to the handle 31. The toggle linkage formed of the handle 31 and the pivot link 35 is biased to its neutral or unfolded condition of FIG. 4 by means of an operating spring 41 which has its one end connected to the pivot pin 36 at the juncture between the pivot link 35 and the handle extension 32 and has the other end hooked at 42 to a portion of a frame 40 fixedly mounted in the base 2 of the housing 1. Also pivoted to the fixed pin 34 of the handle 31 is a latch lever 44 which is triggered by a trip link 51 for movement from a latching position of holding the toggle linkage in folded conditions against the bias of the operating spring 41 in addition to a spring 45 and an unlatching position of permitting it to return to its unfolded condition under the bias of the springs 41 and 45, the latter spring 45 being interposed between an integral rib 5 on the base 2 and the second arm 24 at the portion opposite of the second contact 22 from the pin 29. It is in this latching position that the contacts 21 and 22 are kept closed and opened by the toggle linkage, respectively as shown in FIGS. 1 and 3.

Figure 3:
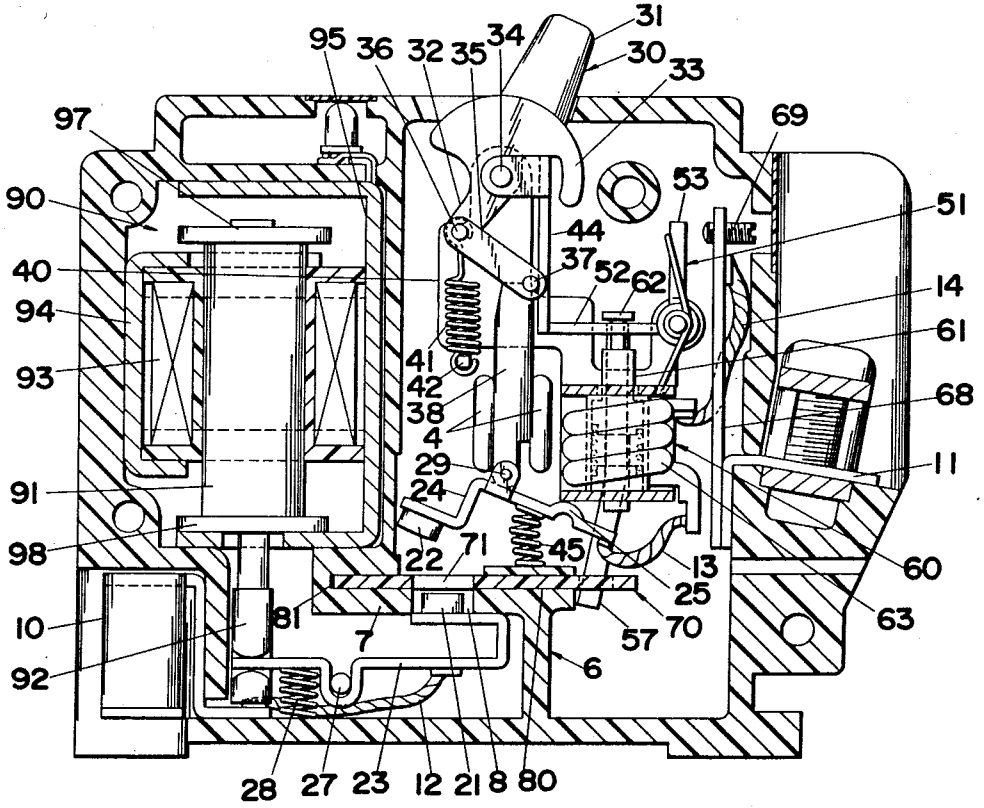
FIG. 3 is a sectional view of the above circuit breaker with its contacts being separated by the manipulation of a handle.

When it is desired to manually close the contacts 21 and 22, the handle 31 is manipulated to rotate counterclockwise, as viewed in FIG. 3, against the bias of the springs 41 and 45. As the handle 31 is rotated to move the upper pivot pin 36 toward the right, the lower pivot pin 37 of the pivot link 35 is guided along the latch lever 44 kept in the latching position to move vertically downwardly as being engaged in the notch 39 of the operator rod 38, pushing downwardly the operator rod 38. Thus, the second arm 24 is correspondingly lowered to bring the second contact 22 into contact engagement with the first contact 21 as compressing the spring 45. This spring 45 urges the second arm 24 to rotate counterclockwise about the pin 29 for giving a desired contact pressure between the closed contacts 21 and 22. When on the other hand the handle 31 is manipulated to the off position of FIG. 3, the pivot link 35 is correspondingly rotated to permit the operator rod 38 to move upwardly under the influence of the spring 45. At this occurrence the spring 45 urges the second arm 24 firstly to jump up for contact separation and secondly to rotate the second arm 24 about its fulcrum 25 which is now in abutting engagement against the bottom of a solenoid casing for providing an increased contact separation distance.

The trip link 51 is an L-shaped member with first and second actuator arms 52 and 53 and is mounted to pivot about a fixed pin 54 for movement between a normal position where the first actuator arm 52 has its free end kept in a latching engaged with the latch lever 44 for retaining it in its latching position and a tripped position where it releases the latch lever 44 to the unlatching position. The trip link 51 is biased by a torsion spring 56 wound about the fixed pin 54 in the clockwise direction, as viewed in the figures, but is prevented by a stopper means (not shown) from being further rotated beyond the normal position of FIG. 1. To motivate the trip link 51 there is provided a solenoid 60 having a plunger 61 carrying at its upper end a catch 62 which is engaged with the first actuator arm 52. The solenoid 60 is supported on the frame 40 and includes a coil 63 surrounding the plunger 61. The coil 63 is electrically inserted between the second arm 24 and the load terminal 11 with its one end connected to the second arm 24 through the braid 13. The other end of the coil 63 is connected through the braid 14 to a bimetallic strip 68 directly connected to the extension of the load terminal 11. The plunger 61 is formed at the portion intermediate its longitudinal ends with a core piece 64 which, upon energization of the coil 63, is attracted toward a fixed core 65 held within the coil 63 against the bias of a spring 66 disposed therebetween. By suitably selecting the strength of the spring 66, there can be determined an over-current value at which the plunger 61 moves against the bias of the spring 66 to activate the trip link 51.

Figure 4:
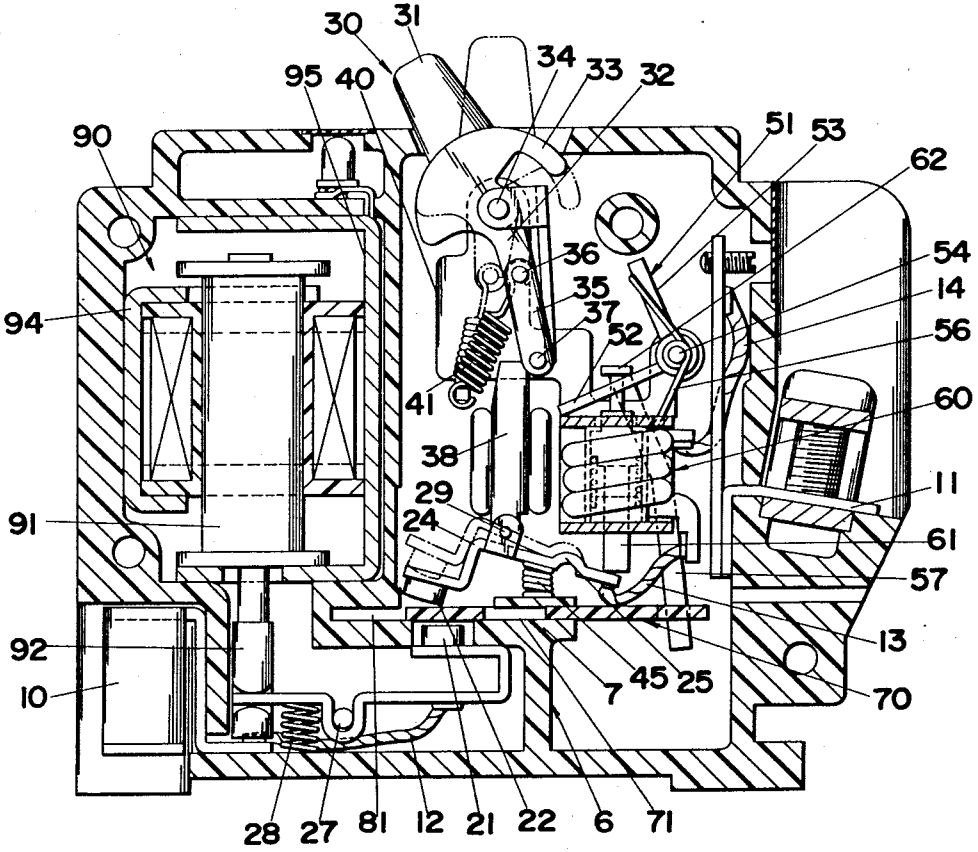
FIG. 4 is a sectional view of the above circuit breaker with its contacts being separated in response to an over-current condition.

Upon the occurrence of any overcurrent exceeding the thus determined value such as in the event of a short-circuit, the plunger 61 pulls down the first actuator arm 52 with the catch 62, as shown in FIG. 4, so as to rotate the trip link 51 against the bias of the torsion spring 56 to its tripped position, releasing the latch lever 44 to its unlatching position and permitting the pivot link 35 freely to rotate under the action of the operating springs 41 and 42. Whereby the lower pivot pin 37 is disengaged from the notch 39 at the top of the operator rod 38, causing the rod 38 to move upwardly by the action of the spring 45 for separating the second contact 22 from the first contact 21. In this way, the solenoid 60 responds to the predetermined over-current condition to separate the contacts through the mechanical linkage including the latch lever 44, pivot link 35 and operator rod 38. The bimetallic strip 68 is also operatively coupled to the trip link 51 with an adjusting screw 69 at one end in an abuttable relation with the other actuator arm 53, so as to actuate the trip link 51 to the tripped condition in response to an overload current level which is somewhat lower than the above over-current level.

The lower end of the plunger 61 extends downwardly out of the solenoid casing to be in abuttable relation with the end of the second arm 24 opposite to the contact 22 in order that, upon the occurrence of the over-current condition, it applies an impact to the second arm 24 to rotate the same about the pin 29 for effecting instantaneous contact separation independently of the above tripping action and therefore free from the mechanical linkage of the operating mechanism. With this consequence, the instantaneous contact separation due to the direct impact on the second arm 24 from the plunger 61 always precedes the contact separation due to the tripping for safely effecting rapid circuit interruption. When this instantaneous contact separation occurs, the trip link 51 is actuated by the same plunger 61 of the solenoid 60 to initiate the tripping for successfully holding the contacts 21 and 22 in the open position as indicated by phantom lines in FIG. 4. Taking into account an inevitable delay from which the mechanical linkage suffers in completing the contact separation from a moment of initiating the tripping of the trip link 51, the plunger 61 is arranged to actuate the trip link 51 and the second arm 24 simultaneously or actuate the trip link 51 slightly sooner so as to finish the contact tripping in an optimum timed manner for successfully holding the contacts in the open position which have been separated due to the above contact opening impact from the plunger 61. From the view point of reducing the load applied to the plunger 61, it is preferred for the plunger 61 to firstly pull the actuator arm 52 of the trip link 51 and strike the second arm 24 immediately thereafter while ensuring the rapid contact separation in response to the overcurrent condition. It is to be noted at this point that the first and second arms 23 and 24 are arranged to have portions extending in parallel relation to each other so that electrodynamic repulsion forces are generated responsive to the over-current flowing therethrough and acting to repel the arms 23 and 24 away from each other, which assist in effecting the rapid contact separation.

After the tripping takes place, the handle 31 is driven by the operating spring 41 to assume the position indicated by a phantom line in FIG. 4. To reset the contacts 21 and 22, the handle 31 is manipulated to rotate to its off position of FIG. 3 during which procedure the pivot link 35 is correspondingly rotated to lift pivot pin 37 into engagement with the notch 39 (see FIG. 2) of the operator rod 38 as reset lever 33 (integral with the handle 31) pushes the latch lever 44 back to its latching position.

Figure 5:
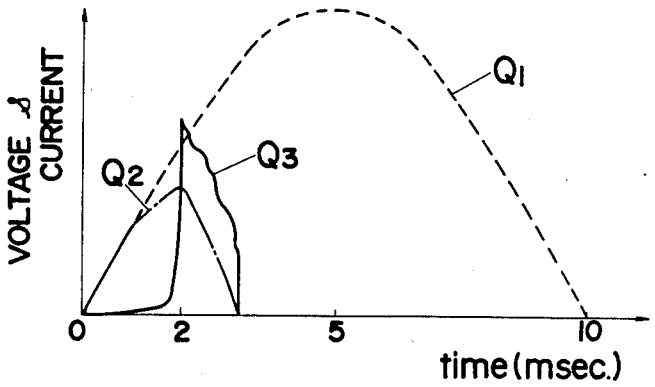
FIG. 5 is a graphical representation of the arc current and arc voltage condition of the above circuit breaker during short-circuit interruption.

The trip link 51 includes a pair of limbs 57 which depends integrally from the actuator arm 52 for connection at the lower ends to an arc shearing plate 70. The arc shearing plate 70 is made of a dielectric material and is slidably held in a horizontal channel 80 formed between the rib 5 and a horizontal segment 7 of a partition 6 integrally formed on the base 2. Suitable dielectric material for the plate 70 includes ceramics and ablative arc quenching materials such as polymethylpentene or polymethylmethacrylate which produces hydrogen in gaseous form upon exposure to the heat of the arcing. The plate 70 is driven by the plunger 61 for movement between a rest position of FIG. 1 where the second contact 22 is located within a window 71 for engagement with the first contact 21 and a shielding position of FIG. 4 where the front end portion of plate 70 is interposed between the contacts 21 and 22 being separated. The depending limbs 57 extend respectively into holes 72 in the rear end of the plate 70 for interlocking the trip link 51 and the plate 70. Thus, the plate 70 is driven by the plunger 61 to move to the shielding position in response to the overcurrent condition. Due to the nature of the high speed plunger movement, the plate 70 moves correspondingly rapidly to the shielding position responsive to the overcurrent condition so that the edge of the window 71 shears an arc being formed between the separating contacts 21 and 22 at a high speed, thereby causing rapid extinction of the arc and ensuring a high arc voltage and current limiting action. The experiment shows that the above construction enables the plate 70 to complete its arc shearing action within a short time period of as less as 2 msec from the occurrence of a short circuit, as shown in FIG. 5 in which curve Q1 represents an estimated short-circuit current which would flow through the circuit in the absence of the plate 70, Q2 represents the instantaneous arc current flowing between the separated contacts 21 and 22, and Q3 represents arc voltage developed between the contacts 21 and 22.

The partition 6 separates the inside of the housing 1 into two spaces one for receiving the first contact 21 and the associated remote signal responsive actuating unit 90 and the other for the second contact 22 and its operating mechanism thereof.

Figure 6:
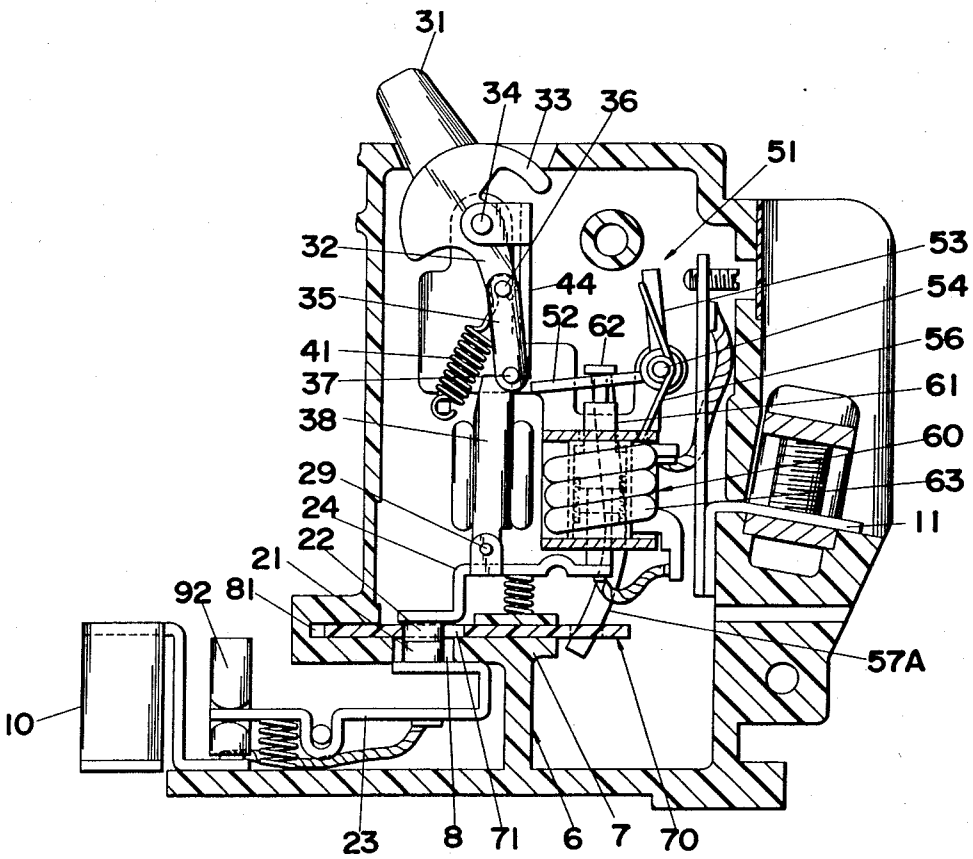
FIG. 6 is a sectional view of a modification of the above circuit breaker.
Figure 7:
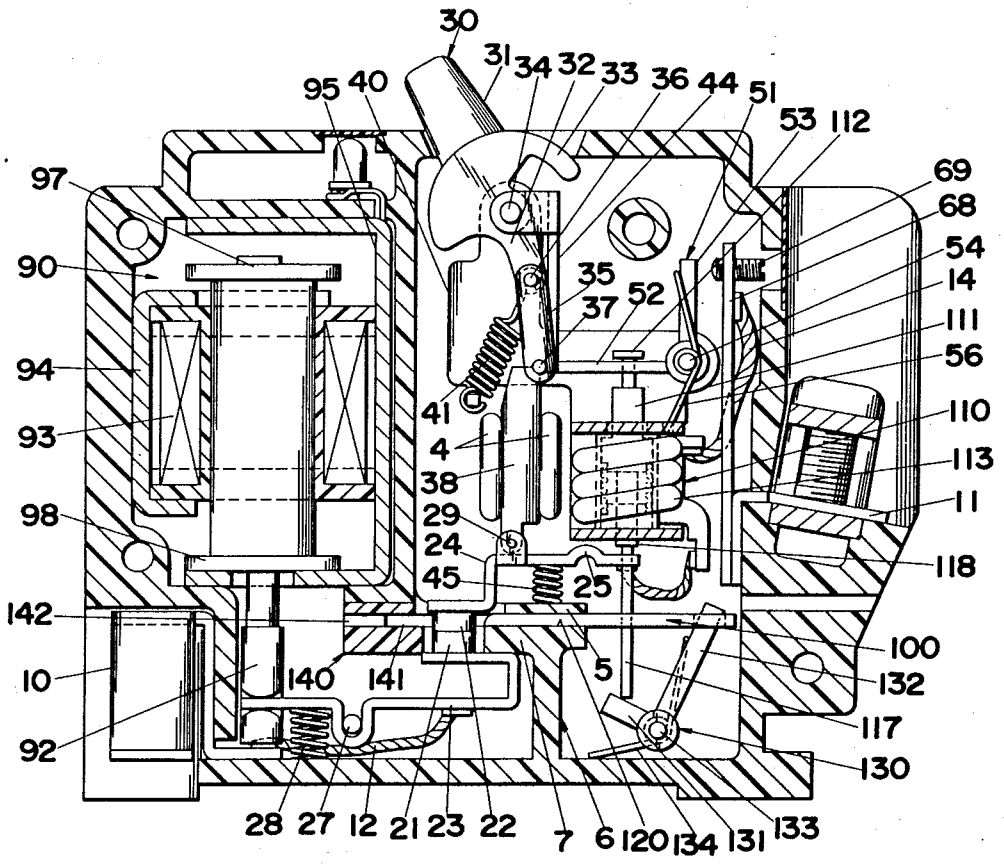
FIG. 7 is a sectional view of a circuit breaker shown in its contact closed position in accordance with a second preferred embodiment of the present invention.

In this connection, the horizontal segment 7 of the partition 6 is formed with an opening 8 through which the second contact 22 is engageable with the first contact 21 and only through which the above spaces are communicated with each other. However, this opening 8 is closed by the arc shearing plate 70 being moved to its shielding position in response to the over-current condition so as to completely seal the above two spaces, preventing the arc leakage therebetween to further improve the rapid arc extinction and current limiting performance. The horizontal segment 7 is formed with a slot 81 which is coactive with the channel 80 to receive therein the leading edge of the plate 70 advancing to the shielding position. The plate 70 is preferably controlled to start moving at a timing slightly delayed from the initiation of the instantaneous contact separation due to the contact opening impact by the plunger 61 for preventing the plate 70 from striking the separating contact 22, which would be possibly the cause of jamming of the moving parts. This timing control can be obtained simply by adopting the somewhat loose engagement between the limbs 57 and the holes 72 of the plate 70. Alternatively, the limbs may be made of a resilient material, as shown in FIG. 6 which is a modification of the first embodiment, such that the limb 57A is firstly deformed resiliently as retaining the plate 70 in its rest position at the initial stage of the tripping movement of the trip link 51 and is subsequently forced to move to the shielding position as releasing accumulated energy in the resilient limbs 57. Thus, the plate 70 can thrust between the contacts 21 and 22 at a higher speed to further improve the arc extinction performance.

The remote signal responsive unit 90 is in the form of a polarized electromagnet with an armature 91 which is coupled at its lower end to the first arm 23 by means of a joint member 92 for actuating the first arm 23 between an operative position where the second contact 22 is engageable with the first contact 21 and an inoperative position where the first contact 21 is no longer engageable with the second contact irrespective of the positions thereof. The electromagnet is of bistable type comprising an excitation coil 93, a U-shaped inner yoke 94, a U-shaped outer yoke 95, and a pair of permanent magnets 96 each interposed between the inner yoke 94 and outer yoke 95. Formed on the armature 91 is a pair of pole plates 97 and 98, one being positioned between the upper pole ends of the inner and outer yokes 94 and 95, and the other between the lower pole ends thereof. The excitation coil 93 is energized by a control signal fed from a location remote from the breaker or from a suitable electric timer used in association with the breaker. Upon selective energization of the coil 93, the armature 91 responds to move upwardly, lifting the end of the first arm 23 to rotate the same about a fixed pin 27 into the inoperative position, where it is stable until the coil 93 is energized by the current of opposite polarity. In the operative position, the first arm 23 is kept stable as compressing a spring 28 disposed between the peripheral wall of the base 2 and the first arm 23. This spring 28 serves to assist the movement of the first arm 23 to the inoperative position when the armature 91 is driven to move upwardly. The remote signal responsive unit 90 is not limited to the bistable type and may be of monostable type according to a particular requirement of controlling the breaker.

Second embodiment [FIGS. 7 to 12]

In accordance with a second preferred embodiment of the present invention there is shown a circuit breaker which is identical in construction and operation to the first embodiment except for an arc shearing plate 100, a driving connection thereof with a plunger 111 of a solenoid 110, and a channel 120 for guiding the plate 100. Other parts are designated by the same numerals as in the first embodiment for a simplicity purpose. The arc shearing plate 100 is slidable received in the horizontally extending channel 120 for movement between a rest position of FIG. 7 where it is away from the contacts 21 and 22 and a shielding position of FIG. 9 where it is interposed between the contacts 21 and 22. The plate 100 is drivingly connected through a pivot lever 130 to the plunger 111 of the solenoid 110 which is of the same construction including an excitation coil 113 inserted in series between the second contact 22 and the load terminal 11. The plunger 111 has an elongated extension 117 which passes through the rear end of the second arm 24 and through a slit 101 in the rear end portion of the plate 100 into abutting engagement with the pivot lever 130. The pivot lever 130 is in the form of a L-shaped member with angularly spaced legs 131 and 132 and is pivotally mounted in the base 2 of the housing 1 about a fixed pin 133 with its shorter leg 131 in abuttable engagement with the extension 117 of the plunger and with a pair of the longer legs 132 engaged in holes 102 in the rear end portion of the plate 100. A torsion spring 134 is wound about the fixed axis 133 for biasing the pivot lever 130 to rotate in the direction of moving the plate 100 to its rest position.

In operation, when the solenoid 110 is energized in response to the over-current condition the plunger 110 is forced to move downwardly, striking the second arm 24 at a flange 118 on its extension 117 for effecting the instantaneous contact separation and at the same time striking the shorter leg 131 of the pivot lever 130 to forcibly rotate it for thrusting the plate 100 to the shielding position against the bias of the spring 134. Thus, the leading edge of the plate 100 act to shear the arc developed between the separating contacts 21 and 22 for rapid arc extinction. It should be noted at this time that the above pivot lever 130 acts as a leverage mechanism which multiplies the motion of the plunger 111 for giving the plate 100 an enough travel distance for movement from its rest position to its shielding position at a higher speed. This allows the use of the smaller solenoid 110 having a relatively short stroke of the plunger 111 as a driving source for moving the plate 110 over a relatively longer distance yet increasing the translational speed of the plate 100.

Figure 8:
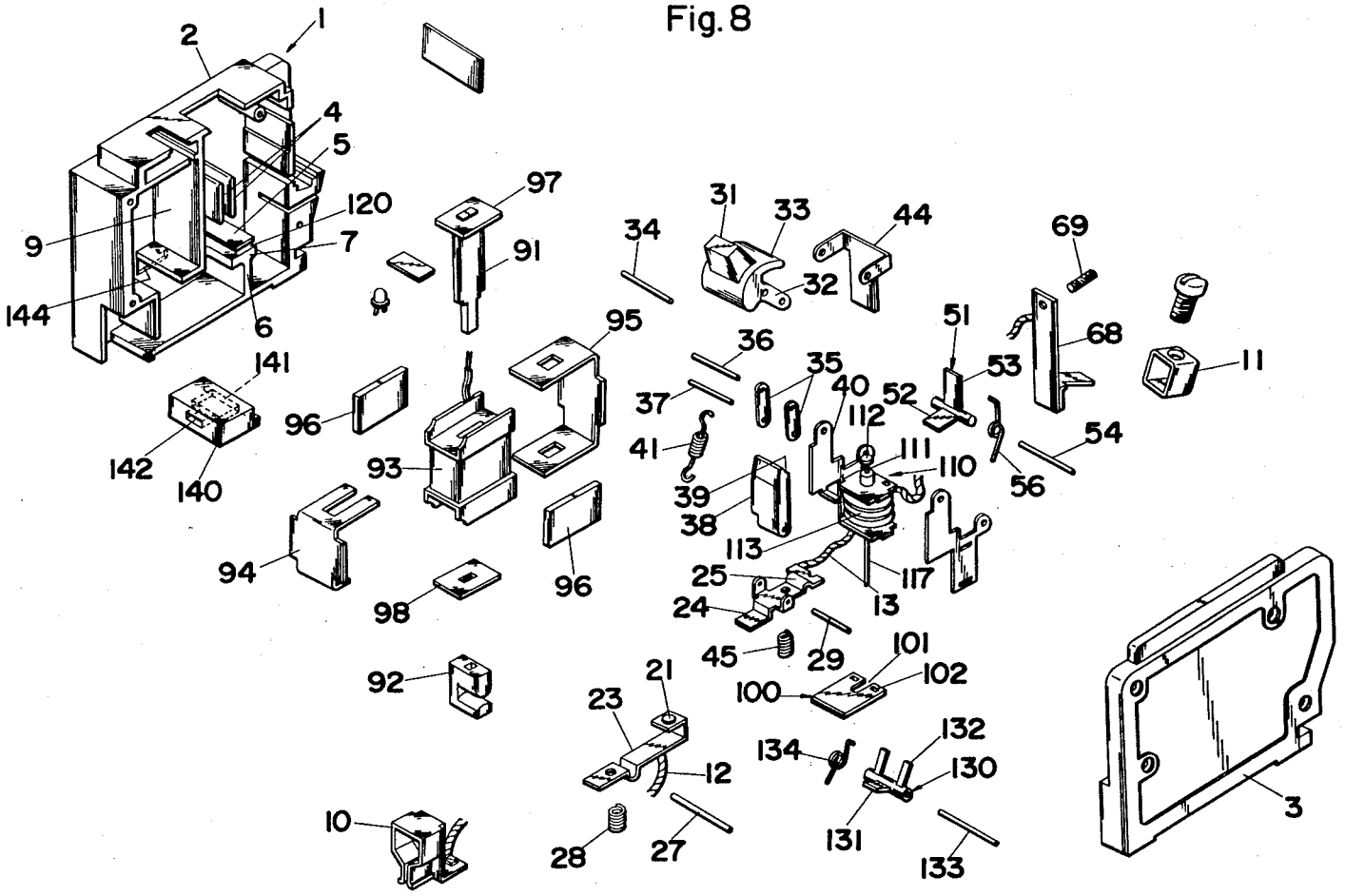
FIG. 8 is an exploded perspective view of the above circuit breaker.
Figure 9:
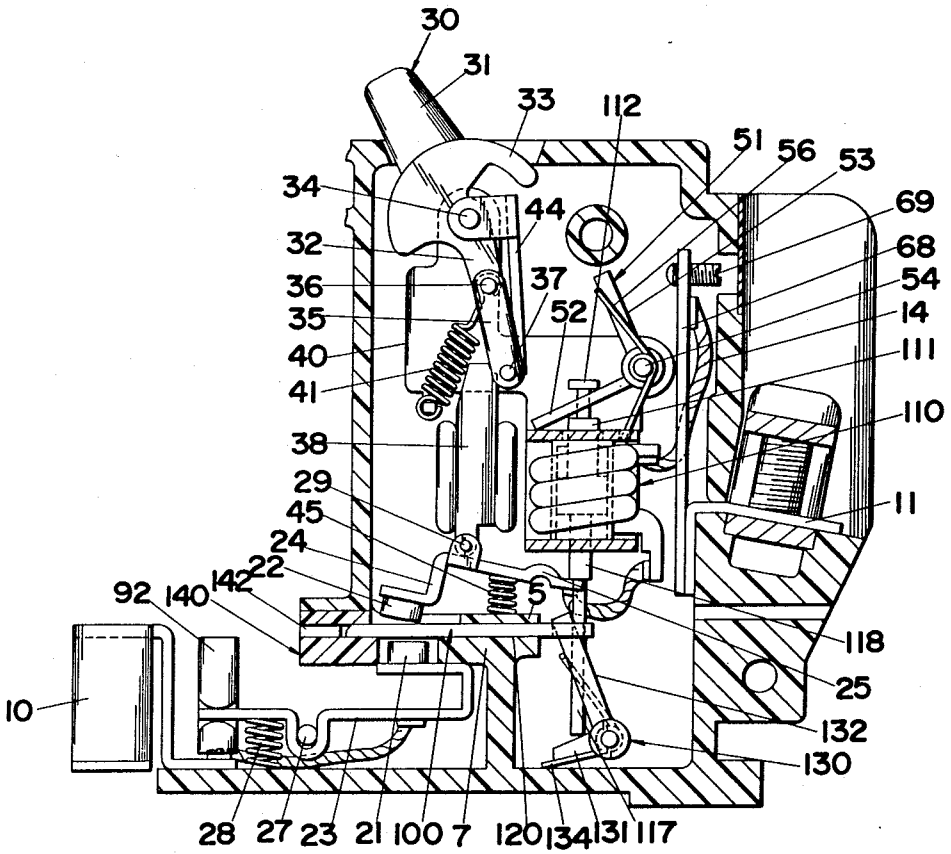
FIG. 9 is a sectional view of the above circuit breaker with is contacts being separated in response to an over-current condition.
Figure 10:
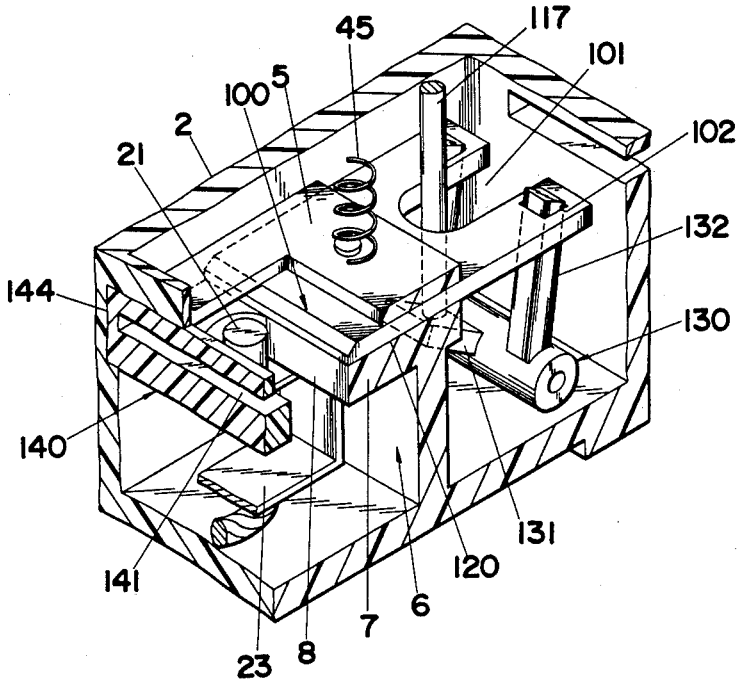
FIG. 10 is a partial view, in a perspective representation, of a portion including an arc shearing plate of the above circuit breaker.
Figure 11:
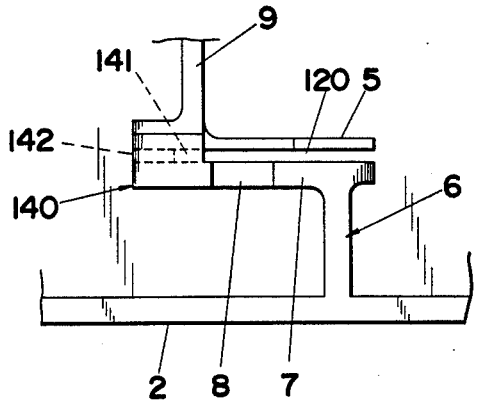
FIG. 11 is a partial view of a housing base of the above circuit breaker.
Figure 12:
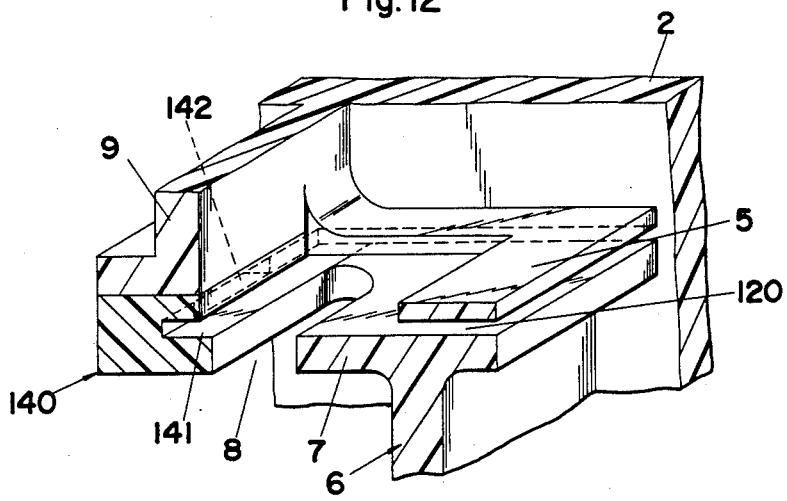
FIG. 12 is a partial view, in a perspective representation, of a portion including a channel for guiding the arc shearing plate.
Figure 13:
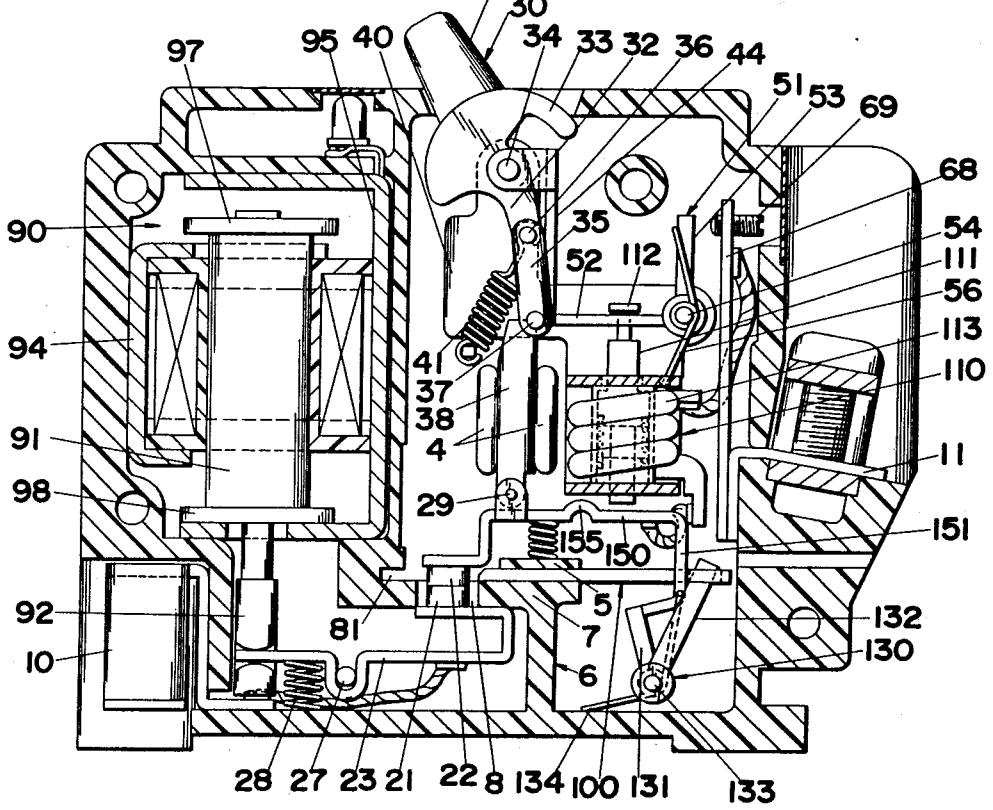
FIG. 13 is a sectional view of a circuit breaker shown in its contact closed position in accordance with a third preferred embodiment of the present invention.
Figure 14:
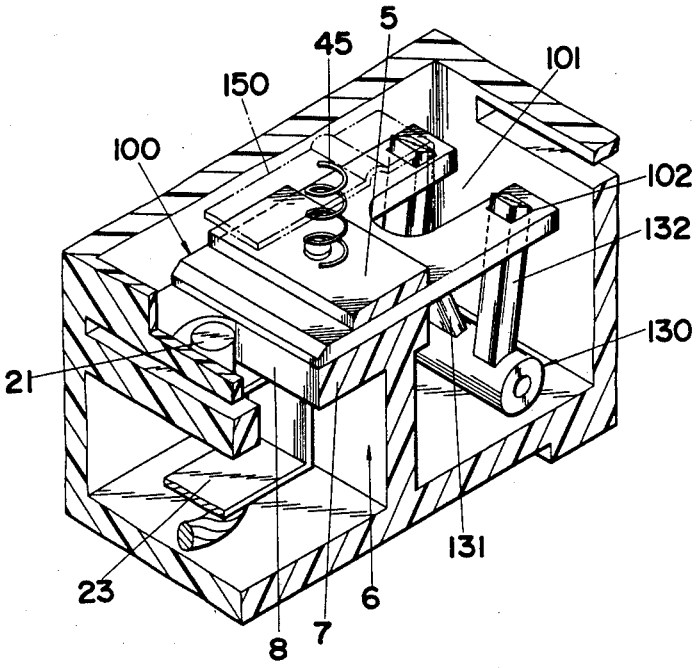
FIG. 14 is partial view, in a perspective representation, of a portion including an arc shearing plate of the above circuit breaker.

As shown in FIGS. 8, and 10 to 12, the channel 120 for guiding the plate 100 is formed partly within the integral members on the base 2 and partly within a block 140 molded separately from the base 2 and held between the base 2 and the cover 3 of the housing 1. Included in the integral members are the rib 5 and the horizontal segment 7 of the partition 6 both projected on the base 2 to form therebetween peripheral portions of the channel 120. The body 140 is made of an ablative arc quenching material which produces hydrogen in gaseous form upon exposure to the heat of the arcing for providing an added effect to enhancing the arc extinction. The ablative material includes, for example, polymethylpentene or polymethylmethacrylate. As best shown in FIGS. 8 and 11, the body 140 has therein an open slot 141 which forms the portion of the channel 120 to receive therein the leading edge of the arc shearing plate 100 when it moves to the shielding position. Also formed in the body 140 is an air vent 142 which extends from the inner end of the slot 141 and terminates at the end face of the body 140 so that the air in the slot 141 can escape therethrough as the leading edge of the plate 100 advances into abutment with the end of the slot 141, thus preventing the bouncing of the plate 100 to ensure smooth translational movement thereof to the shielding position. The body 140 is positioned at the lower end of a vertical partition 9 on the base 2 with its lateral ends inserted in the recesses 144 respectively in the base 2 and the cover 3 (only one of the recesses is shown in the figure). The body 140 is cooperative with the partitions 9 and 6 to form a continuous wall except for the opening 8 for receiving therein the first contact 21, which wall serving to separate the inside of the housing 1 into two spaces, one for receiving the first contact 21 and the associated members including the remote signal responsive unit 90 and the other for the second contact 22 and the associated operating mechanism and the tripping mechanism thereof. When the arc shearing plate 100 moves to the shielding position of inserting itself between the separated contacts 21 and 22 responsive to the over-current condition, it closes the opening 8 to completely seal the spaces from each other, preventing the arc leakage therebetween to enhance the rapid arc extinction in addition to the effect of the arc extinguishing gases generated from the body 140 made of the ablative arc quenching material when exposed to the intense heat of the arc.

Third embodiment [FIGS. 13 to 17]

Figure 15:
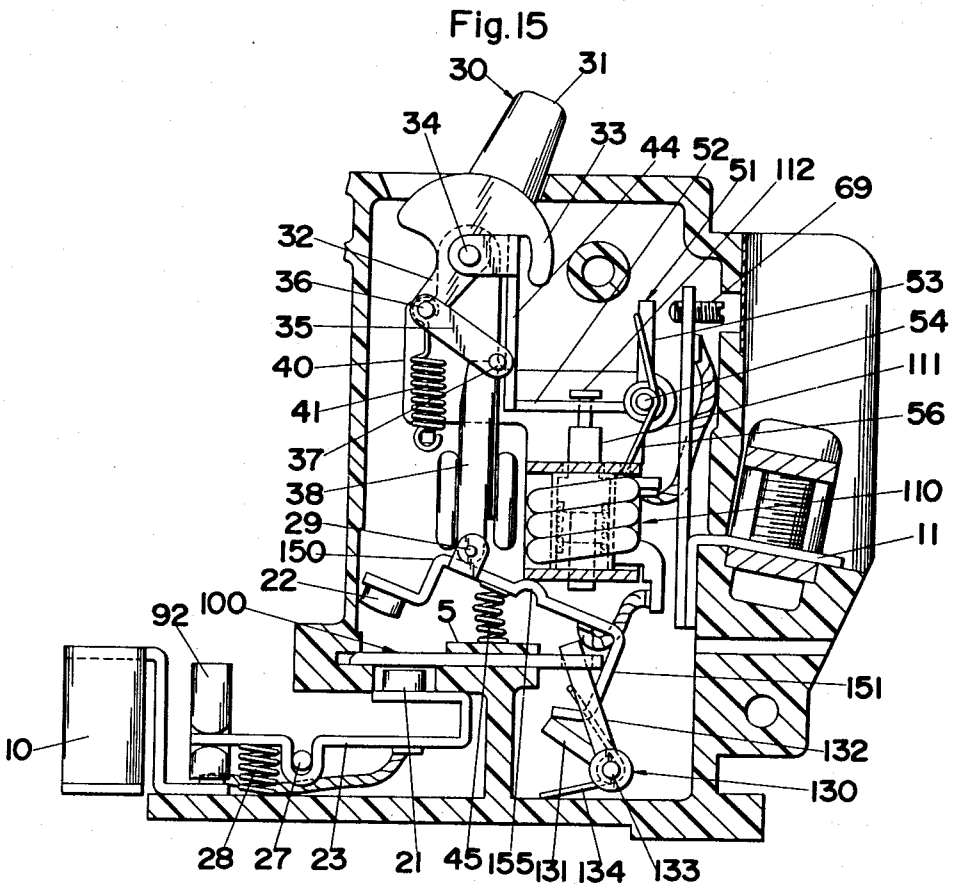
FIG. 15 is a sectional view partly being cut away of the above circuit breaker with its contacts being manually separated.

Referring to FIGS. 13 to 17, there is shown a third preferred embodiment of the present invention which is identical in construction and operation to the second embodiment except that the arc shearing plate 100 is driven from the solenoid 110 by the use of a specifically shaped second arm 150 carrying the second contact 22. Like numerals apply to like parts for the sake of simplicity. The second arm 150 is shaped to have an actuator extension 151 which depends from the end of the arm 150 opposite to the second contact 22 through a slit 101 in the rear portion of the arc shearing plate 100 into abutting engagement with the shorter leg 131 of the pivot lever 130 which is connected to the arc shearing plate 100 by means of the longer leg 132 in the same manner as in the second embodiment. When the contacts 21 and 22 are kept in the closed position of FIG. 13, the second arm 150 is pressed downward by the operator rod 38 to which it is pivoted by means of the pin 29, at which condition the spring 45 act to rotate the second arm 150 about the pin 29 for providing a suitable contacting pressure. When the second arm 150 is separated by the manual operation of the handle 31, the second arm 150 is allowed to jump upwardly by the action of the spring 45 and further rotated about its fulcrum 155 engaging the lower end of the solenoid casing, as shown in FIG. 15. At this occurrence, the actuator extension 151 pushes the short leg 131 of the pivot lever 130, rotating the pivot lever 130 to thrust the arc shearing plate 100 to the shielding position of inserting itself between the separated contacts 21 and 22.

Figure 16:
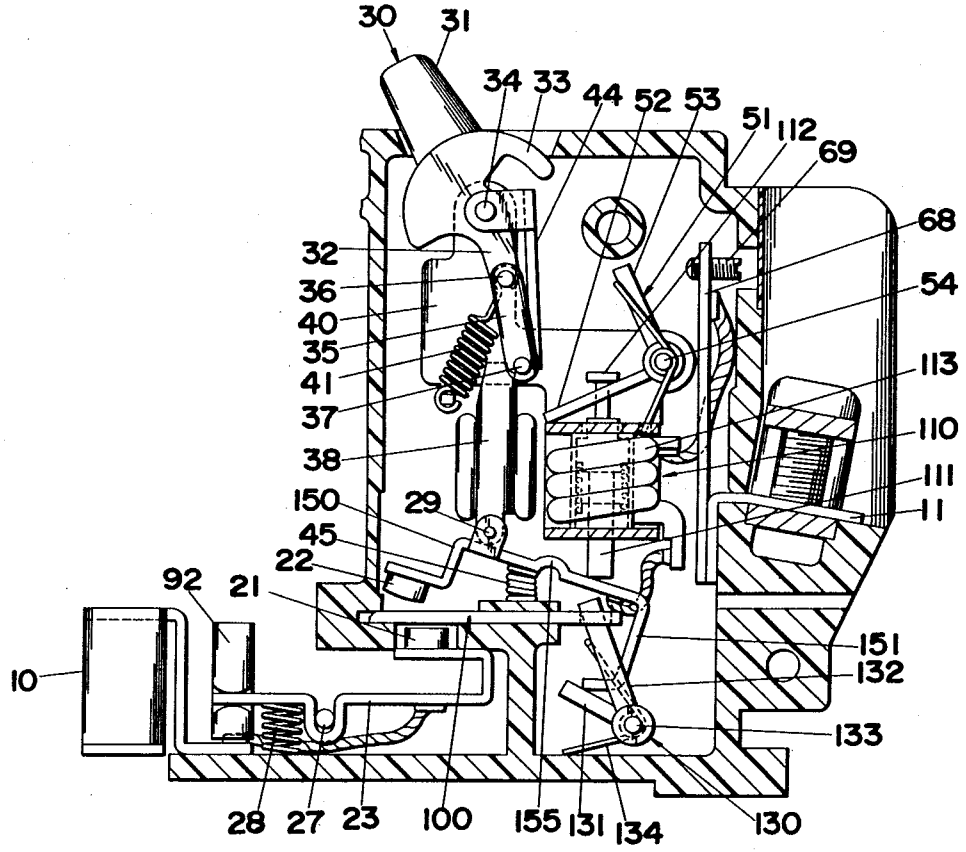
FIG. 16 is a sectional view partly being cut away of the above circuit breaker with its contact being separated in response to an over-current condition.
Figure 17:
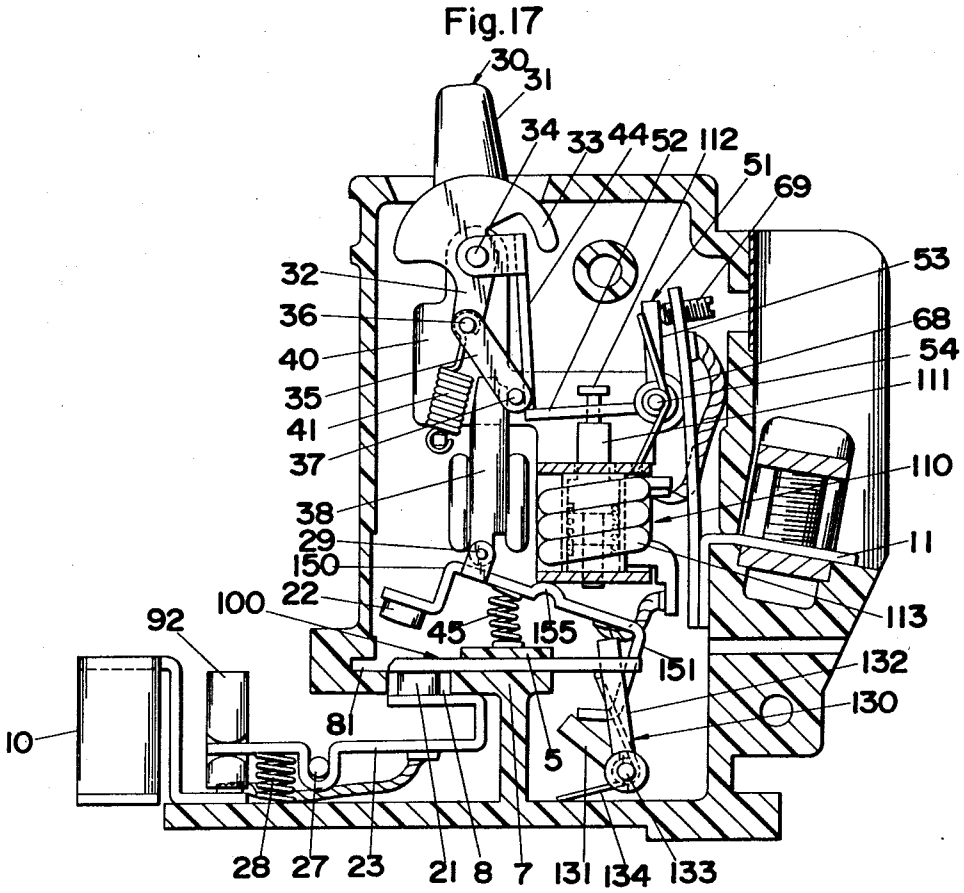
FIG. 17 is a sectional view partly being cut away of the above circuit breaker with its contacts being held in the open position by the actuation of a trip mechanism.

Upon the occurrence of the over-current condition, the solenoid 110 responds to forcibly move its plunger 111 downward so as to pull down the trip link 51 for initiating the tripping of the mechanical linkage and substantially simultaneously strike the second arm 150 to rotate it about the pin for instantaneous contact separation, as shown in FIG. 16. At this moment, the rotating second arm 150 is operative to rotate the pivot lever 130 by its actuator extension 151 to thrust the arc shearing plate 100 between the separating contacts 21 and 22 for shearing the arc formed therebetween. After the tripping of the mechanical linkage takes place in sequence of the instantaneous contact separation, the second arm 150 is kept opened by the action of the spring 45 and the plate 100 remains in the position of interposing itself between the contacts 21 and 22, as shown in FIG. 17. The plate 100 is automatically moved back to the rest position at the time of resetting the contacts by manipulating the handle 31 in the same manner as described with reference to the first embodiment.

What is claimed is:

1. A current limiting circuit breaker with an arc shearing plate comprising:

a contact means including a pair of electrical contacts mounted within a housing wherein at least one of the contacts is movable with respect to the other contact between open and closed positions;

an over-current responsive impact imparting means which is connected to act directly upon said contact means without any intervening structure for applying a contact opening impact to said movable contact so as to make rapid contact separation is response to a predetermined value of overcurrent; and an arc shearing plate mounted within the housing to be movable between a rest position where it is away from the contacts and a shielding position where it is interposed between the contacts as they are being separated, said arc shearing plate being operatively connected to said over-current responsive impact imparting means such that it is driven by said impact imparting means to move, in synchronism with said rapid contact separation due to the overcurrent condition, into the shielding position for shearing the arc formed between the contact being separated.

2. A current limiting circuit breaker as set forth in claim 1, wherein said over-current responsive impact imparting means is a solenoid with a plunger which responds to the predetermined over-current condition for applying the contact opening impact directly to a movable contact arm carrying said movable contact for making said rapid contact separation.

3. A current limiting circuit breaker with an arc shearing plate comprising:

a contact means including a pair of electrical contacts mounted within a housing wherein at least one of the contacts is movable with respect to the other contact between open and closed positions;

an operating means including a handle and operatively connected through a mechanical linkage to said contact means for manual contact separation by the handle, said mechanical linkage including a latchable member which is movable between a latch position for holding the contacts in the closed positon and an unlatched position for holding the contacts in the open position;

a trip means operatively connected to said mechanical linkage of the operating means for releasing the latchable means to the unlatched position in response to an overload condition to effect the trip separation of the contacts;

an over-current responsive impact imparting means which is connected to act directly upon said contact means without any intervening structure for applying a contact opening impact to said movable contact so as to make rapid contact separation in response to a predetermined value of over-current and independently of said trip means;

an arc shearing plate mounted within the housing to be movable between a rest position where it is away from the contacts and a shielding position where it is interposed between the contacts as they are being separated, said arc shearing plate being operatively connected to said over-current responsive impact imparting means such that it is driven by said impact imparting means to move, in synchronism with said contact separation due to the over-current condition, into the shielding position for shearing the arc formed between the contacts being separated.

4. A current limiting circuit breaker as set forth in claim 3, wherein said over-current responsive impact imparting means is a solenoid with a plunger which responds to the predetermined over-current condition for applying the contact opening impact to a movable contact arm carrying said movable contact for making said rapid contact separation.

5. A current limiting circuit breaker as set forth in claim 4, wherein said plunger of the solenoid is operatively connected to said trip means so that it responds to the over-current condition for initiating the tripping of said mechanical linkage substantially simultaneously with said rapid contact separation as well as with the synchronized movement of said arc shearing plate into the shielding position.

6. A current limiting circuit breaker with an arc shearing plate comprising:

a contact means including a pair of electrical contacts mounted within a housing wherein at least one of the contacts is movable with respect to the other contact between open and closed positions;

an operating means including a handle and operatively connected through a mechanical linkage to said contact means for manual contact separation by the handle, said mechanical linkage including a latchable member which is movable between a latched position for holding the contacts in the closed position and an unlatched position for holding the contacts in the open position;

a trip means operatively connected to said mechanical linkage of the operating means for releasing the latchable means to the unlatched position in response to an overload condition to effect the trip separation of the contacts;

an over-current responsive impact imparting means which is connected to act directly upon said contact means without any intervening structure for applying a contact opening impact to said movable contact so as to make rapid contact separation in response to a predetermined value of over-current independently of said trip means;

an arc shearing plate mounted within the housing to be movable between a rest position where it is away from the contacts and a shielding position where it is interposed between the contacts as they are being separated, said arc shearing plate being operatively connected to said impact imparting means such that it is driven by said impact imparting means to move, in synchronism with said rapid contact separation due to the over-current condition, into the shielding position for shearing the arc formed between the contacts being separated; and said trip means including a trip link which is operatively connected to the impact imparting means such that it is actuated thereby in response to the over-current condition for movement to a tripped position where it releases the latchable member to its unlatched position, and said trip link being interlocked with said arc shearing plate for movement thereof to the shielding position substantially simultaneously with the rapid contact separation and with the initiation of the tripping of said mechanical linkage.

7. A current limiting circuit breaker as set forth in claim 4, wherein said arc shearing plate is slidably held within the housing for movement between the rest and shielding position along a straight path and wherein said plunger of the solenoid is operatively connected to said arc shearing plate by means of a leverage mechanism which multiplies the motion of the plunger for giving to the arc shearing plate an enough travel distance for movement from its rest position to its shielding position.

8. A current limiting circuit breaker with an arc shearing plate comprising:

a contact means including a pair of electrical contacts mounted within a housing wherein at least one of the contacts is movable with respect to the other contact between open and closed positions;

an operating means including a handle and operatively connected through a mechanical linkage to said contact means for manual contact separation by the handle, said mechanical linkage including a latchable member which is movable between a latched position of holding the contacts in the closed position and an unlatched position of holding the contacts in the open position;

a trip means operatively connected to said mechanical linkage of the operating means for releasing the latchable means to the unlatched position in response to an overload condition to effect the trip separation of the contacts;

an over-current responsive solenoid with a plunger which is connected to said contact means for applying a contact opening impact thereto so as to make rapid contact separation in response to a predetermined value of over-current independently of said trip means;

an arc shearing plate mounted within the housing to be movable between a rest position where it is away from the contacts and a shielding position where it is interposed between the contacts being separated, said arc shearing plate being operatively connected to said plunger such that it is driven thereby to move, in synchronism with said rapid contact separation due to the over-current condition, into the shielding position for shearing the arc formed between the contacts being separated; and said arc shearing plate being slidably held within the housing for movement between the rest and shielding position along a straight path, said plunger of the solenoid being connected to said arc shearing plate by means of a leverage mechanism which multiplies the motion of the plunger for giving to the arc shearing plate an enough travel distance for movement from its rest position to its shielding position.

9. A current limiting circuit breaker as set forth in claim 4, wherein said arc shearing plate is slidably received within a channel formed in the interior of the housing so as to be guided thereby in its movement between the rest and shield positions.

10. A current limiting circuit breaker as set forth in claim 9, wherein said channel is formed in a member which is slotted at a portion receiving the leading edge of said arc shearing plate so as to provide an opening thereat by which the channel is in open communication with the outside of the member.

11. A current limiting circuit breaker as set forth in claim 9, wherein said channel is formed in a member separate from the housng and is secured in place with the housing, said member being made of a material having a high rate of gas generation by ablation when exposed to the heat of the arc formed between the separating contacts.

12. A current limiting circuit breaker with an arc shearing plate comprising:

a contact means including a pair of electrical contacts mounted within a housing wherein at least one of the contacts is movable with respect to the other contact between open and closed positions;

an operating means including a handle and operatively connected through a mechanical linkage to said contact means for manual contact separation by the handle, said mechanical linkage including a latchable member which is movable between a latched position for holding the contacts in the closed position and an unlatched position for holding the contacts in the open position;

a trip means operatively connected to said mechanical linkage of the operating means for releasing the latchable means to the unlatched position in response to an overload condition to effect the trip separation of the contacts;

an over-current responsive solenoid with a plunger which is connected to act directly upon said contact means without any intervening structure for applying a contact opening impact thereto so as to make rapid contact separation in response to a predetermined value of over-current independently of said trip means;

an arc shearing plate mounted within the housing to be movable between a rest position where it is away from the contacts and a shielding position where it is interposed between the contacts as they are being separated, said arc shearing plate being operatively connected to said plunger such that it is driven by said solenoid to move, in synchronism with said contact separation due to the over-current condition, into the shielding position for shearing the arc formed between the contacts being separated; and said plunger being connected to act directly upon a movable contact arm carrying said movable contact so as to apply a contact opening impact thereto for rapid contact separation in response to the over-current condition, said arc shearing plate being operatively connected to the movable contact arm so as to be driven thereby to move into its shielding position.

13. A current limiting circuit breaker with an arc shearing plate comprising:

a contact means including a set of first and second contacts mounted within a housing for movement between open and closed positions, said first contact being mounted on a first movable arm and said second contact being mounted on a second movable arm;

an operating means including a handle and operatively connected through a mechanical linkage to said second movable arm for manual contact separation by the handle, said mechanical linkage including a latchable member which is movable between a latched position for holding the second arm in the closed position and an unlatched position for holding the second arm in the open position;

a trip means operatively connected to said mechanical linkage of the operating means for releasing the latchable means to the unlatched position in response to an overload condition to effect the trip separation of the contacts;

an over-current responsive solenoid with a plunger which is operatively connected to act directly upon said second arm for applying a contact opening impact thereto so as to make rapid contact separation in response to a predetermined value of over-current independently of said trip means;

an arc shearing plate mounted within the housing to be movable between a rest position where it is away from the contacts and a shielding position where it is interposed between the contacts being separated, said arc shearing plate being operatively connected to said plunger of the solenoid such that it is driven thereby to move, in synchronism with said rapid contact separation due to the over-current condition, into the shielding position for shearing the arc formed between the contacts being separated; and a remotely controllable actuating means which in response to a remote signal actuates said first movable arm for movement between an operative position where the first contact is engageable with the second contact and an inoperative position where it is prohibited from engaging the second contact irrespective of the position of the second arm.

14. A current limiting circuit breaker as set forth in claim 6, wherein said over-current responsive impact imparting means is a solenoid with a plunger which responds to the predetermined over-current condition for applying the contact opening impact directly to a movable contact arm carrying said movable contact for making said rapid contact separation.

* * * * *